US010343876B2

(12) United States Patent
Kolb et al.

(10) Patent No.: US 10,343,876 B2
(45) Date of Patent: Jul. 9, 2019

(54) MOBILE CRANE

(71) Applicant: Liebherr-Werk Ehingen GmbH, Ehingen/Donau (DE)

(72) Inventors: Markus Kolb, Laupheim (DE); Lars Eberhardt, Stalg (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 432 days.

(21) Appl. No.: 15/354,040

(22) Filed: Nov. 17, 2016

(65) Prior Publication Data

US 2017/0355576 A1 Dec. 14, 2017

(30) Foreign Application Priority Data

Jun. 13, 2016 (DE) ..... 20 2016 003 698 U

(51) Int. Cl.
*B66C 23/74* (2006.01)
*B66C 23/36* (2006.01)
*B66C 23/76* (2006.01)

(52) U.S. Cl.
CPC ..... *B66C 23/74* (2013.01); *B66C 23/36* (2013.01); *B66C 23/76* (2013.01); *B66C 2700/0342* (2013.01)

(58) Field of Classification Search
CPC ..... B66C 23/74; B66C 23/76; B66C 23/36; B66C 2700/0342; B62D 49/085; E02F 9/18
See application file for complete search history.

(56) References Cited

U.S. PATENT DOCUMENTS 2,261,870 A * 11/1941 Cardwell ..... B66C 23/36 212/196
2,408,500 A * 10/1946 West ..... B66C 23/76 212/196
2,891,681 A * 6/1959 Greivell ..... B62D 49/085 212/196
3,375,048 A * 3/1968 Korensky ..... B66C 23/74 212/178
3,481,488 A * 12/1969 Pilletere, Jr. ..... B66C 23/36 108/131
3,891,095 A * 6/1975 Symmank ..... B66C 23/74 212/178
4,286,720 A * 9/1981 Atkinson ..... B66C 23/74 212/178
5,598,935 A * 2/1997 Harrison ..... B62D 49/085 180/69.1

(Continued)

*Primary Examiner* — Michael E Gallion
(74) *Attorney, Agent, or Firm* — Dilworth & Barrese, LLP

(57) ABSTRACT

This invention relates to a mobile crane with a traveling undercarriage and an uppercarriage rotatably mounted on the same, to which on the one hand a boom is luffably articulated and on which on the other hand a counterweight assembly is arranged on the uppercarriage, in which a counterweight plate is connectable via a counterweight receptacle, in that the same is pivotable from a pick-up position into a deposited position about at least one bolt arranged on the counterweight receptacle. According to the invention, at least one further bolt is arranged on the counterweight receptacle parallel to the at least one bolt, which while swinging down the counterweight plate engages into a corresponding curve-shaped recess of the counterweight plate for securing the same.

11 Claims, 4 Drawing Sheets

(56) References Cited

U.S. PATENT DOCUMENTS

| | | | | |
|---|---|---|---|---|
| 5,833,268 | A * | 11/1998 | Aldrovandi | B60R 9/00 280/759 |
| 6,065,620 | A * | 5/2000 | McGhie | B66C 23/74 212/178 |
| 7,093,729 | B2 * | 8/2006 | Monteil | B66C 23/74 212/178 |
| 7,618,062 | B2 * | 11/2009 | Hamm | B62D 49/085 280/759 |
| 9,394,146 | B2 * | 7/2016 | Schroder | B66C 23/62 |
| 10,066,365 | B2 * | 9/2018 | Cartechini | E02F 9/18 |
| 2002/0053551 | A1 * | 5/2002 | Koster | B66C 23/70 212/177 |
| 2007/0122261 | A1 * | 5/2007 | Hamaguchi | B66C 23/74 414/729 |
| 2008/0099421 | A1 * | 5/2008 | Pech | B66C 23/76 212/196 |
| 2015/0097362 | A1 * | 4/2015 | Jutz | B62D 49/0628 280/759 |
| 2015/0139768 | A1 * | 5/2015 | Egawa | E02F 9/18 414/719 |
| 2017/0051473 | A1 * | 2/2017 | Rutherford | E02F 9/18 |
| 2018/0044150 | A1 * | 2/2018 | Mori | E02F 9/18 |
| 2018/0155162 | A1 * | 6/2018 | Eberhardt | B66C 23/365 |

* cited by examiner

MOBILE CRANE

BACKGROUND OF THE INVENTION

This invention relates to a mobile crane with a traveling undercarriage and an uppercarriage rotatably mounted on the same, to which on the one hand a boom is luffably articulated and on which on the other hand a counterweight assembly is arranged.

In mobile cranes the counterweight required for their crane operation is at least partly deposited on the uppercarriage. The counterweight usually is placed as necessary in the form of counterweight plates to be stacked on each other. A bottommost counterweight plate initially is placed on a counterweight receptacle connected with the uppercarriage. However, the counterweight plate deposited on the counterweight receptacle still must be secured against slipping and falling down in crane operation or when traveling on a construction site. For this purpose, suitable securing elements are to be provided, which must be mounted by the operating personnel for example in the form of bolts, chains, screw connections, tension belts or the like.

SUMMARY OF THE INVENTION

It is the object of the invention to distinctly simplify and accelerate the ballasting of a generic mobile crane during its provision.

In accordance with the invention, this object is solved by the combination of the features herein. Proceeding from a mobile crane with a traveling undercarriage and an uppercarriage rotatably mounted on the same, to which on the one hand a boom is luffably articulated and on which on the other hand a counterweight assembly is arranged, in which a counterweight plate is connectable with the undercarriage via a counterweight receptable, in that the same is pivotable from a pick-up position into a deposited position about at least one bolt arranged on the counterweight receptacle, this object is solved in that on the counterweight receptacle, parallel to the at least one bolt, at least one further bolt is arranged, which while swinging down the counterweight plate engages into a corresponding curve-shaped recess of the counterweight plate for securing the same.

The bolts mentioned in the aforementioned solution quite generally are to be understood as bearing points in bolt form. In the sense of the solution presented here, a bolt for example also is meant to be a cast console with a rounded point as pivot bearing. The further bolt for example can be designed as desired, in order to fulfill the function of a counter connection element. Quite generally, the bolts are components which provide for a swivel movement of the counterweight plate and for securing of the same.

Due to this configuration, a pivotable counterweight plate at the same time can be placed onto the counterweight receptacle and be secured against slipping and falling down during the crane operation or during traveling of the crane on a construction site. Additional bolting or some other securement no longer is necessary, as the at least one additionally provided bolt engages into the correspondingly curve-shaped recess during the swivel movement. The curve shape of the recess is chosen such that in the deposited position the counterweight plate is secured by the two bolts arranged in parallel, without a further bolt or another securement having to be plugged or mounted here by an operating person.

Advantageous aspects of the invention can be taken from the description herein.

Accordingly, the counterweight receptacle can consist of swivel arms pivotally arranged on the uppercarriage, which via swivel drives are pivotable from a maximally retracted into a maximally extended position, steplessly or in various incremental positions. Corresponding pivoting for example can be effected hydraulically via piston-cylinder assemblies or via electrically driven adjusting means. In principle, such swivel drives are necessary, as the bearing forces are very large in the vertical swivel bearing.

Furthermore advantageously, further counterweight plates can be stacked onto the first counterweight plates swung in and automatically secured in their position, in order to obtain counterweight stacks.

Particularly advantageously, a connecting piece can be arranged on the counterweight receptacle, on the sides of which the bolts each arranged parallel to each other are arranged opposite each other. Parallel tabs which are arranged on the counterweight plate to be swung in can correspond with these bolts. The parallel tabs therefor advantageously are formed fork-shaped to form a pivot point. Furthermore, they also include the curve-shaped recess for receiving the further bolt.

Particularly advantageously, the width of the curve-shaped recess is dimensioned larger than the diameter of the bolt to be received. In its end position, too, the bolt does not rest against the end of the recess. A corresponding safety distance thereby is maintained, so that striking of the bolt while swinging down, but also at the end in the deposited position is prevented. It thereby is ensured that the total weight of the counterweight plate is borne by corresponding bearing points, while the securing bolts are relieved completely. Especially in the deposited position the large weight and the corresponding moment of the counterweight plate hence is absorbed by these bearing points on the counterweight assembly.

The fork-shaped tabs advantageously can be beveled on at least one side at their free ends. Particularly advantageously, they are beveled on all sides. Centering by the resulting bevels thereby is simplified, when the counterweight plate is placed on the bolts, and meshing also is simplified during pivoting into the second bolt.

The counterweight plates deposited on the counterweight receptacle in the aforementioned way advantageously can be removed during the travel and be built up on the crane at another point. For example, an arrangement on the sliding beam box of the undercarriage during road travel of the mobile crane is suitable for this purpose. The respective counterweight plate here can be fixed via preferably pluggable transport bolts. This application for example is typical in mobile cranes with corresponding approval for road use in countries with increased permissible axle loads, e.g. in England.

In other legal axle load limitations for road travel, as this is the case for example in Germany, the counterweight plates are not transported on the mobile crane itself, but separately on a further accompanying vehicle. It therefore is not necessary to separate the counterweight plates from the weight receiving plate during disassembly of the crane.

According to a further advantageous aspect of the invention the counterweight plate therefore can firmly be connected together with the counterweight receptacle. For this purpose, the counterweight plate in the position swung down additionally is bolted to the counterweight receptacle by means of bolts. Via corresponding pick-up and contact points arranged on the counterweight plate, the counterweight plate thus can be lifted off during assembly and disassembly together with the counterweight receptacle.

Due to this configuration, the entire implement advantageously can be adapted to the different country-specific requirements.

BRIEF DESCRIPTION OF THE DRAWINGS

Further features, details and advantages of the invention can be taken from a preferred embodiment illustrated in the drawing, in which.

DESCRIPTION OF THE PREFERRED EMBODIMENTS

Figure 1:
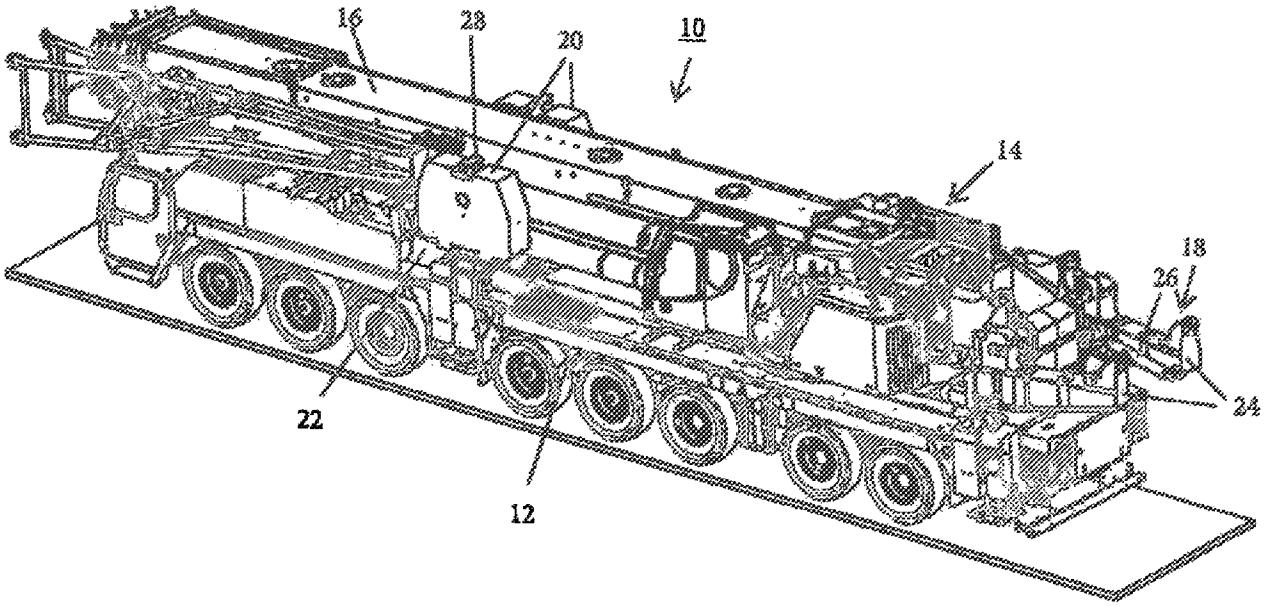
FIG. 1: shows a perspective representation of a mobile crane according to the present invention in the driving condition in countries with higher permissible axle loads, i.e. in the road travel condition and with counterweight receptacle.

FIG. 1 shows a mobile crane 10 in a perspective representation. The same in the usual way includes an undercarriage 12 and an uppercarriage 14 rotatably mounted on the same. On the uppercarriage 14 a boom 16 is luffably mounted about a non-illustrated luffing axis. On the uppercarriage 14 a counterweight assembly 18 furthermore is arranged, which is connected with the uppercarriage 14.

Figure 3:
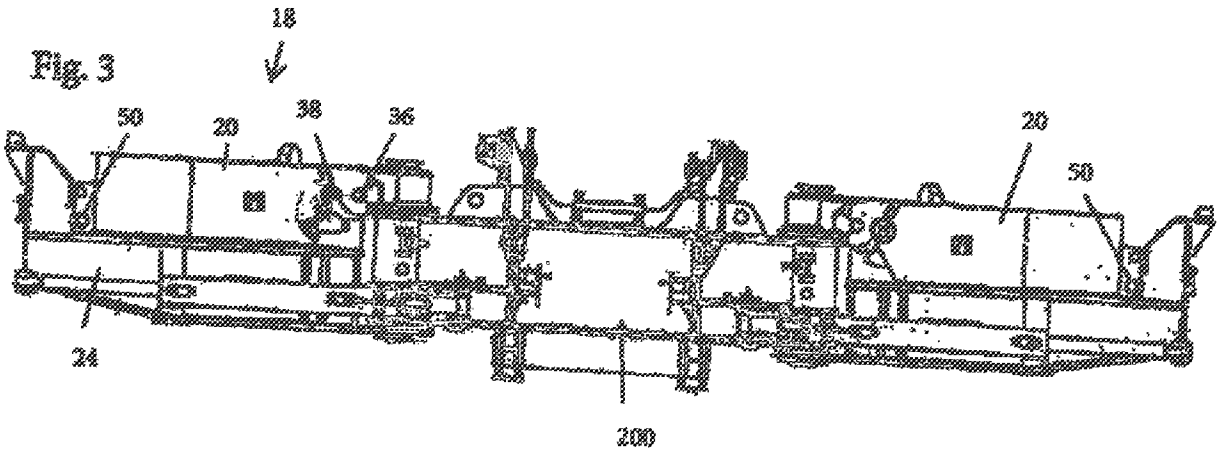
FIG. 3: shows a representation of the counterweight plate in crane operation.
Figure 5:
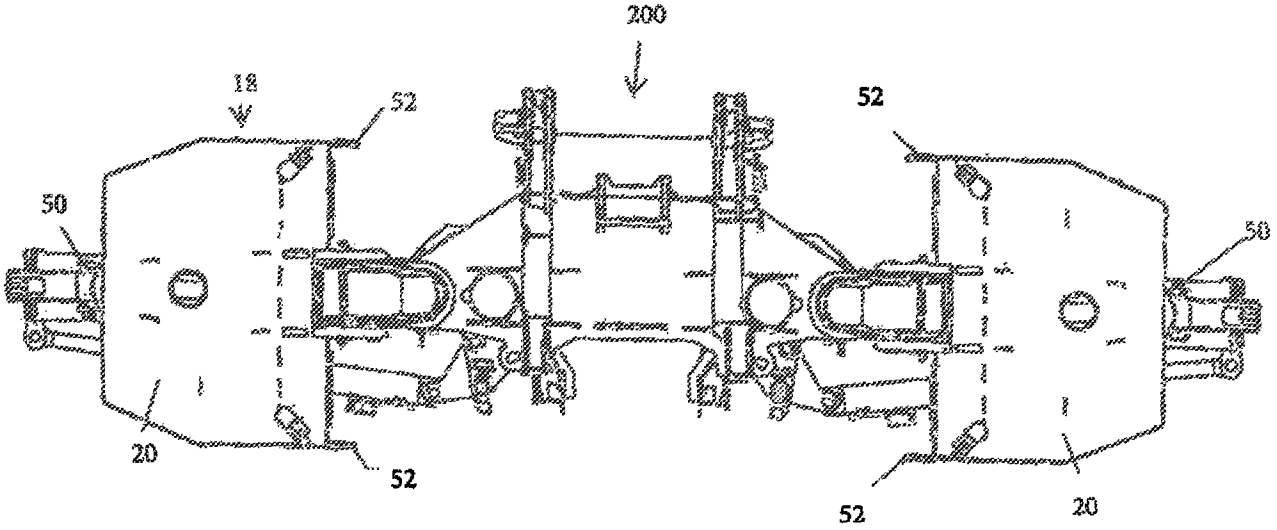
FIG. 5: shows a top view of the counterweight assembly in the transport condition without transport means.

The counterweight assembly 18 consists of counterweight plates 20 (two pieces on which further counterweight plates can be stacked), two swivel arms 24 and the counterweight frame 200 (cf. FIGS. 3 and 5). It is designed removable. In the configuration shown here in FIG. 1, the mobile crane 10 is provided for road travel. The counterweight assembly 18 therefore is shown here without attached counterweight plate 20. In the embodiment of the mobile crane 10 shown here, the two lower counterweight plates 20, which are placed on the counterweight frame 200 right at the bottom, are arranged laterally on a sliding beam box 22 of the undercarriage 12 and fixed with suitable fixing means.

The embodiment represented in FIG. 1 shows a mobile crane 10 which takes account of the following situation. A mobile crane 10 which is provided for traveling in public road traffic, for example in Germany, must be designed with a uniform axle load of 12 t. In other countries, for example England, on the other hand it is allowed to drive in public road traffic with much larger axle loads. Crane operators would like to make use of this advantage in that more assemblies are carried along with the crane in road traffic. These assemblies then need not separately be mounted on the construction site. The separate transport via a low loader also can be omitted in this embodiment. The counterweight assembly 18 is designed correspondingly according to this second design variant shown in FIG. 1. During road travel it can remain on the uppercarriage 14. To uniformly distribute the axle load, the bottommost counterweight plates 20, which are part of the counterweight assembly 18, can be arranged on the sliding beam box 22 of the undercarriage 12 in the transport position as shown in FIG. 1.

Beside the counterweight plates 20 and the counterweight frame 200 the counterweight assembly 18 in particular includes the counterweight receptacle which in the illustrated embodiment according to FIG. 1 consists of two swivel arms 24, which are connected with the uppercarriage 14 via piston-cylinder assemblies 26. The lower counterweight plates 20 are locked on the swivel arms 24 so as to be removed quickly, if necessary. For this purpose the mobile crane 10 itself can pick up and lift the lower counterweight plates 20 at a pick-up point 28. Thus, the mobile crane 10 can lift the bottommost counterweight plate 20 out of the transport position as shown in FIG. 1 and place it on a bolt, which is arranged on the swivel arm 24, in vertical position and swing it down about the same into its deposited position on the swivel arm 24.

This swivel movement from the attached vertical position of the bottommost counterweight plate 20 into a deposited position is shown in detail with reference to FIGS. 2*a* to 2*d*.

Figure 2A:
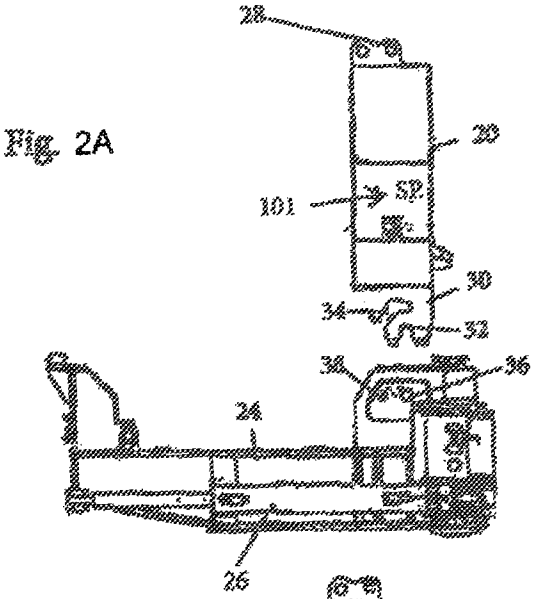
FIGS. 2A, 2B, 2C and 2D: show schematic views of various positions of a counterweight plate during its assembly on the counterweight receptacle.
Figure 2B:
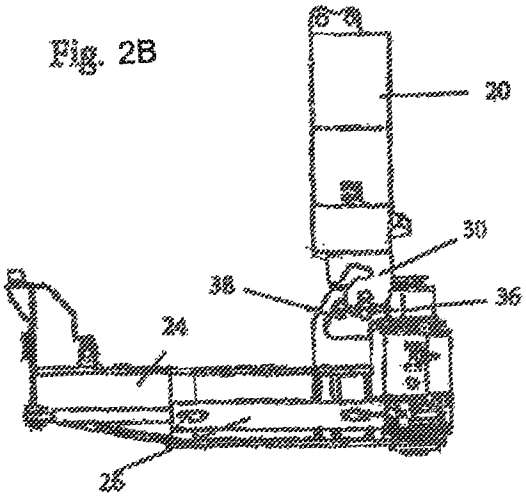
Figure 2C:
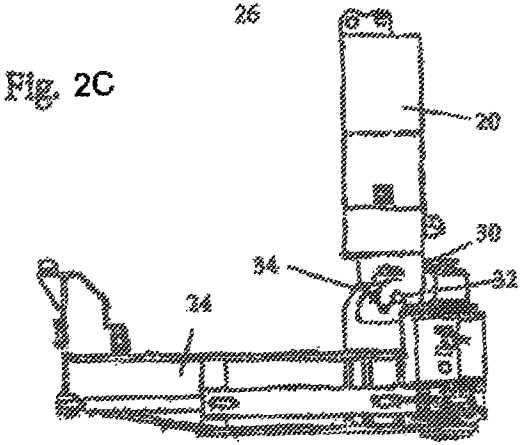
Figure 2D:
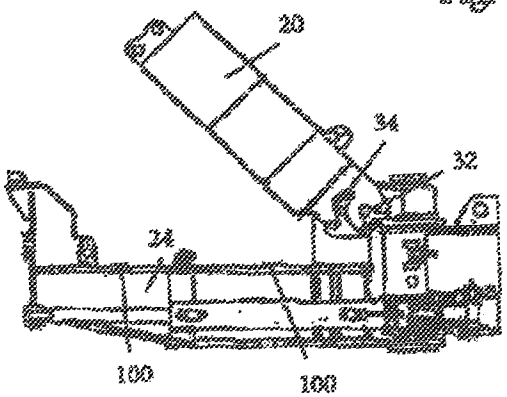
Figure 4A:
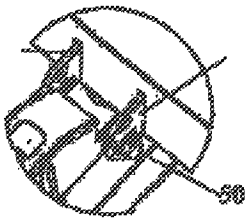
FIGS. 4A, 4B and 4C: show details of the connection between the counterweight plate and the counterweight receptacle.

In FIG. 2*a*, the counterweight plate 20 is lowered in direction onto the swivel arm 24. For this purpose, the crane hook (not shown) of the mobile crane 10 is connected with the pick-up point 28 on the counterweight plate 20 in a likewise not illustrated manner. On the side of the counterweight plate 20 opposite the pick-up point 28 parallel tabs 30 are arranged (cf. also FIGS. 4*a* and 4*b*). These tabs each are formed fork-like to form a pivot point 32. The tabs 30 furthermore include a curve-shaped recess 34. The fork forming the pivot point 32, as is shown in particular in FIGS. 2*b* and 2*c* as well as 4*a*, can be placed on corresponding bolts 36 and be pivoted about the same (cf. FIG. 2*d*). During the swivel movement about the bolt 36 a bolt 38 arranged parallel to the same enters into the curve-shaped recess 34 in the tabs 30 (cf. FIGS. 2*c* and 2*d*). The center of gravity 101 of the counterweight plate 20 especially is arranged with respect to the position of the swivel axis 32. The swivel axis 32 is formed by the fork of the tab 30 in conjunction with the bolt 36. When lowering the counterweight plate 20, which is attached to a non-illustrated holding rope, the weight force acting in the center of gravity 101 generates a moment about the swivel axis 32. This weight force especially is utilized for moving the counterweight plate 20 and for locking the counterweight plate 20 on the swivel arm 24 (cf. FIGS. 2*a* to 2*d*).

Figure 4B:
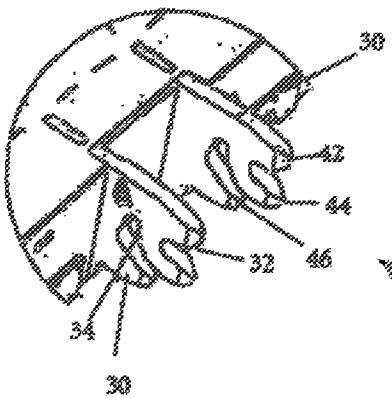
Figure 4C:
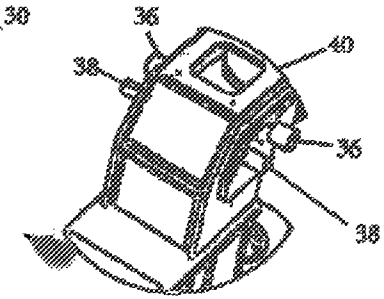

As is shown in FIG. 4*c*, a connecting piece 40 is formed on the swivel arm 24 forming the counterweight receptacle, on whose sides the bolts 36 and 38 each arranged parallel to each other are arranged opposite each other. The corresponding recesses of the tabs 30 engage into the same. In the region of the recesses, as shown in FIG. 4*b*, the fork-like tabs 30 are provided with lateral bevels 42, 44 and 46, which simplify meshing when the counterweight assembly is placed on the bolts 36 or on the bolts 38. In analogy to the tabs 30, the connecting piece 40 also can include bevels and chamfers, in order to facilitate lateral meshing. The counterweight plate 20 is secured against lateral slipping by the connecting piece 40 itself.

FIGS. 3 and 5 show the counterweight assembly 18 provided with the counterweight plates 20. The counterweight plates 20 here are placed on the swivel arms 24. They are in their deposited position. They are secured against slipping or falling down in crane operation or during a travel of the mobile crane by the bolts 36 and 38, which on the one hand engage into the pivot point 32 of the fork-shaped tab 30 and the curve-shaped recess 34. The curve-shaped recess 34 forms a coulisse shaped such that by means of the bolt 38 a corresponding lateral shifting can be prevented. The curve-shaped recess 34 is dimensioned such that it is broader than the diameter of the bolt to be received. It thereby is ensured that in the deposited position the bolt does not rest against the wall of the curve-shaped recess. In its deposited position, too, as it is shown in FIG. 3, the bolt 38 does not rest against the end of the recess 34. It thereby is prevented that even a part of the weight of the deposited counterweight plate 20 rests on the bolt(s) 38. A plurality of further counterweight plates can yet be deposited on the counterweight plate 20. During the swivel movement of the counterweight plate 20, the bolt 38 of course slides along the guide surface. There exists a clearance which, however, is dimensioned such that a swivel movement just is possible without jamming. Nevertheless, the required guidance always is ensured.

In this above-described design variant the counterweight plates 20 can easily be placed by the crane hook itself and be secured in the deposited position by swinging, without the operating personnel here having to place a further bolt. A corresponding disassembly is possible in reverse order in the same simple way.

For the case that the entire counterweight receptacle 18, which beside the counterweight plate 20 also includes the swivel arms 24, must be removed for the road travel of the mobile crane 10, it is recommendable to not only demount the counterweight plates 20 alone, but to demount the counterweight plates 20 together with the swivel arms 24. For this purpose, the counterweight plate 20 can be bolted to the swivel arm 24, if necessary, via a pluggable bolt 50. The counterweight plate 20 here is connected with the counterweight plate 20 to form a unit via the bolts 50 and 36, 38. Via contact points 52 this entire counterweight receptacle 18 consisting of the bottommost counterweight plates 20 and the swivel arm 24 as well as the counterweight frame 200 can be picked up from the uppercarriage 14 after corresponding disassembly. The entire unit then is deposited for example on a low loader for road transport. This application is recommendable for example in Germany, as the crane otherwise would exceed the permissible axle loads during road travel.

The invention claimed is:

1. A mobile crane with a traveling undercarriage and an uppercarriage rotatably mounted on which a boom is luffably articulated and on which a counterweight assembly is arranged on the uppercarriage, in which a counterweight plate is connectable via a counterweight receptacle, the counterweight plate being pivotable from a pick-up position into a deposited position about at least one first bolt arranged on the counterweight receptacle, wherein on the counterweight receptacle, at least one further bolt is arranged parallel to the at least first one bolt, which while swinging the counterweight plate down, engages into and slides along a corresponding curve-shaped recess of the counterweight plate for securing the counterweight plate.

2. The mobile crane according to claim 1, wherein the counterweight receptacle consists of swivel arms pivotally arranged on the uppercarriage, which via swivel drives are steplessly pivotable from a maximally retracted into a maximally extended position.

3. The mobile crane according to claim 1, wherein further counterweight plates can be stacked onto the first counterweight plate swung in to form counterweight stacks.

4. The mobile crane according to claim 1, wherein on the counterweight receptacle, a connecting piece is arranged, on sides thereof the bolts each arranged parallel to each other are arranged opposite each other.

5. The mobile crane according to claim 4, wherein on the counterweight plate to be swung in parallel tabs are arranged, which are formed fork-shaped to form a pivot point and include the curve-shaped recess to receive the further bolt.

6. The mobile crane according to claim 1, wherein the curve-shaped recess is broader than the diameter of the bolt to be received.

7. The mobile crane according to claim 5, wherein the fork-shaped tabs are beveled on at least one side at their free ends.

8. The mobile crane according to claim 1, wherein a base plate to be swung in can be bolted to the counterweight receptacle by bolts on a side opposite the curve-shaped recess.

9. The mobile crane according to claim 8, wherein during disassembly of the mobile crane, the counterweight plate bolted to the counterweight receptacle can jointly be picked up via corresponding contact points.

10. The mobile crane according to claim 1, wherein the pivotable counterweight plate can be mounted on a sliding beam box of the undercarriage for transport during a road travel of the mobile crane.

11. The mobile crane according to claim 10, wherein the pivotable counterweight plate can be mounted on the undercarriage via preferably pluggable transport bolts for transport during the road travel of the mobile crane.

* * * * *